US007980828B1

(12) United States Patent
Lantz et al.

(10) Patent No.: US 7,980,828 B1
(45) Date of Patent: Jul. 19, 2011

(54) MICROELECTROMECHANICAL PUMP UTILIZING POROUS SILICON

(75) Inventors: Jeffrey W. Lantz, Albuquerque, NM (US); Harold L. Stalford, Norman, OK (US)

(73) Assignee: Sandia Corporation, Albuquerque, NM (US)

( * ) Notice: Subject to any disclaimer, the term of this patent is extended or adjusted under 35 U.S.C. 154(b) by 981 days.

(21) Appl. No.: 11/739,716

(22) Filed: Apr. 25, 2007

(51) Int. Cl.
*F04B 19/24* (2006.01)
*F01D 23/00* (2006.01)

(52) U.S. Cl. ..... 417/207; 417/410.1

(58) Field of Classification Search ..... 417/207, 417/410.1; 137/828; 422/505, 522
See application file for complete search history.

(56) References Cited

U.S. PATENT DOCUMENTS

| | | | | |
|---|---|---|---|---|
| 5,360,759 | A | 11/1994 | Stengl et al. | |
| 5,501,893 | A | 3/1996 | Laermer et al. | |
| 5,729,984 | A | 3/1998 | Hemmerrich et al. | |
| 5,871,336 | A * | 2/1999 | Young | 417/207 |
| 6,171,378 | B1 | 1/2001 | Manginell et al. | |
| 6,533,554 | B1 | 3/2003 | Vargo et al. | |
| 6,902,701 | B1 | 6/2005 | Hughes et al. | |
| 6,930,051 | B1 | 8/2005 | Manginell et al. | |
| 2004/0179946 | A1 | 9/2004 | Gianchandani et al. | |
| 2004/0244356 | A1 | 12/2004 | Ronney | |
| 2005/0095143 | A1 | 5/2005 | Bernard et al. | |
| 2006/0022330 | A1 | 2/2006 | Mallari | |
| 2006/0147741 | A1 | 7/2006 | Ho et al. | |

OTHER PUBLICATIONS

S. Ottow et al, "Processing of Three-Dimensional Microstructures Using Macroporous n-Type Silicon", J.Electrochem.Soc, vol. 143, No. 1, Jan. 1996, pp. 385-390.

V. Lehmann, "Porous Silicon—A New Material for MEMS", Proceedings of the Ninth Annual International Workshop on Micro Electro Mechanical Systems, MEMS '96, Feb. 1996, pp. 1-6.

Robert M. Young, "Analysis of a micromachine based vacuum pump on a chip actuated by the thermal transpiration effect", J.Vac.Sci. Technol. B, vol. 17, No. 2, Mar./Apr. 1999, pp. 280-287.

Stephen E. Vargo et al, "Initial Results from the First MEMS Fabricated Thermal Transpiration-Driven Vacuum Pump", CP585, Rarefied Gas Dynamics: 22nd International Symposium, American Institute of Physics, 2001, pp. 502-509.

(Continued)

*Primary Examiner* — William H Rodriguez
*Assistant Examiner* — Philip Stimpert
(74) *Attorney, Agent, or Firm* — Olivia J. Tsai

(57) ABSTRACT

A microelectromechanical (MEM) pump is disclosed which includes a porous silicon region sandwiched between an inlet chamber and an outlet chamber. The porous silicon region is formed in a silicon substrate and contains a number of pores extending between the inlet and outlet chambers, with each pore having a cross-section dimension about equal to or smaller than a mean free path of a gas being pumped. A thermal gradient is provided along the length of each pore by a heat source which can be an electrical resistance heater or an integrated circuit (IC). A channel can be formed through the silicon substrate so that inlet and outlet ports can be formed on the same side of the substrate, or so that multiple MEM pumps can be connected in series to form a multi-stage MEM pump. The MEM pump has applications for use in gas-phase MEM chemical analysis systems, and can also be used for passive cooling of ICs.

20 Claims, 10 Drawing Sheets

OTHER PUBLICATIONS

Shamus McNamara et al, "A Micromachined Knudsen Pump for On-Chip Vacuum", The 12th International Conference on Solid State Sensors, Actuators and Microsystems, Boston, Jun. 8-12, 2003, pp. 1919-1922.

A. A. Alexeenko et al, "Modeling of Thermal Transpiration Flows for Knudsen Compressor Optimization", 43rd AIAA Aerospace Sciences Meeting and Exhibit, Jan. 10-13, 2005-0963, Reno, Nevada, pp. 1-11.

Shamus McNamara et al, "On-Chip Vacuum Generated by a Micromachined Knudsen Pump", Journal of Microelectromechanical Systems, vol. 14, No. 4 Aug. 2005, pp. 741-746.

S.S. Tsao et al, "Porous Silicon Formation in N-/N+/N-Doped Structures", J.Electrochem.Soc, vol. 138, No. 6, Jun. 1991, pp. 1739-1743.

Tsao, S. S., Porous Silicon Formation in N-/N+/N-Doped Structures, J. Electrochem, Soc., vol. 136, No. 6, Jun. 1991, pp. 1739-1743.

* cited by examiner

MICROELECTROMECHANICAL PUMP UTILIZING POROUS SILICON

GOVERNMENT RIGHTS

This invention was made with Government support under Contract No. DE-AC04-94AL85000 awarded by the U.S. Department of Energy. The Government has certain rights in the invention.

FIELD OF THE INVENTION

The present invention relates in general to microelectromechanical (MEM) devices, and in particular to a MEM pump (also termed a thermal transpiration pump, or a Knudsen pump) comprising a porous silicon region. The MEM pump has applications for use in gas-phase MEM chemical analysis devices, and for passive cooling of integrated circuits (ICs).

BACKGROUND OF THE INVENTION

Recently, interest has been rekindled in forming thermal transpiration pumps since these pumps have no moving parts, do not require oil, and can operate in any orientation. Additionally, thermal transpiration pumps are amenable to miniaturization for use with microelectromechanical (MEM) devices. Previous attempts to form Knudsen pumps have utilized an aerogel comprising suspended silicon dioxide particles, a photopolymer, a plurality of stacked spherical particles, or very shallow channels etched into a substrate (see U.S. Pat. Nos. 5,871,336 and 6,533,554; and U.S. Patent Publication No. 2004/0179946).

The present invention provides an advance over the prior art by forming a microelectromechanical (MEM) Knudsen pump (hereafter referred to as a MEM pump) using a porous silicon region formed in a silicon substrate.

An advantage of the MEM pump of the present invention is that the porous silicon can be formed with a pore size (i.e. a cross-section size of each pore) that can be predetermined to be anywhere in the range of 10 nanometers to 10 microns or more.

Another advantage of the present invention is that the MEM pump can be integrated with other gas-phase MEM devices including chemical preconcentrators, gas chromatographs, detectors, etc.

Yet another advantage of the present invention is that a multi-stage MEM pump can be formed on a common substrate by connecting together in series multiple MEM pumps each tailored to operate in a different gas pressure regime.

These and other advantages of the present invention will become evident to those skilled in the art.

SUMMARY OF THE INVENTION

The present invention relates to a microelectromechanical (MEM) pump for pumping a gas. The MEM pump comprises an inlet chamber for receiving the gas; an outlet chamber in thermal communication with a heat source; and a silicon substrate separating the inlet chamber from the outlet chamber, with the silicon substrate comprising a porous silicon region having a plurality of pores extending between the inlet chamber and the outlet chamber, and with a cross-section dimension of each pore being substantially equal to or smaller than a mean free path length of the gas to pump the gas from the inlet chamber to the outlet chamber in response to a thermal gradient provided along a length of each pore by the heat source. The cross-section dimension of the pores can be, for example, in a range of 10 nanometers to 10 microns.

An inlet port can be located on one side of the silicon substrate and connected to the inlet chamber; and an outlet port can be located on the same side of the silicon substrate and connected to the outlet chamber. This can be done by providing a channel formed through the substrate to connect the outlet chamber to the outlet port, or alternately by providing a channel formed through the substrate to connect the inlet chamber to the inlet port. Locating the inlet and outlet ports on the same side of the silicon substrate using the channel formed through the substrate can facilitate making external connections to the MEM pump (e.g. with tubing). Also, the provision of the channel through the substrate is useful for connecting a plurality of MEM pumps in series to form a multi-stage MEM pump.

The heat source can comprise an electrical resistance heater. In some embodiments of the present invention, the electrical resistance heater can be supported by a lid which forms one or more walls of the outlet chamber. In other embodiments of the present invention, the electrical resistance heater can be supported on a suspended membrane (e.g. comprising silicon nitride or silicon dioxide).

In yet other embodiments of the present invention, the heat source can comprise an integrated circuit (IC) which is in thermal communication with a lid which forms at least one wall of the outlet chamber. In these embodiments of the present invention, the heat generated by the IC can act to pump a gas (e.g. air) through the MEM pump, with the gas being heated and thereby removing heat from the IC. In this way, the IC can be passively cooled without requiring any electrical power for the MEM pump, or any external pump to flow the gas through the porous silicon region.

The present invention also relates to a MEM pump for pumping a gas which comprises a silicon substrate having a plurality of pores formed therethrough with each pore having a first end in fluid communication with an inlet chamber located on a first major surface of the silicon substrate, and with each pore having a second end in fluid communication with an outlet chamber located on a second major surface of the silicon substrate. Each pore is substantially straight and aligned substantially perpendicular to the major surfaces of the silicon substrate, and can have a cross-section dimension which is substantially equal to or less than a mean free path of the gas. An electrical resistance heater is located proximate to the second end to provide a thermal gradient between the first and second ends of each pore to draw the gas through each pore. The cross-section dimension of each pore is generally in a range of 10 nanometers to 10 microns, with the exact cross-section dimension of each pore depending upon a pressure of the gas being pumped.

The silicon substrate can have a channel formed therethrough to transport the gas from the outlet chamber to the first major surface of the silicon substrate. The electrical resistance heater can be supported on a suspended membrane, or by a lid which forms at least one wall of the outlet chamber.

The present invention further relates to a MEM pump for pumping a gas which comprises a silicon substrate having a first major surface and a second major surface, with an inlet chamber being formed on the first major surface of the silicon substrate, and with an outlet chamber being formed on the second major surface of the silicon substrate, and with the outlet chamber being in fluid communication with an outlet channel which extends through the silicon substrate to the first major surface thereof. A porous silicon region is formed in the silicon substrate, with the porous silicon region comprising a plurality of pores extending between the inlet chamber and the outlet chamber. Each pore is substantially straight and has a cross-section dimension in the range of 10 nanometers to 10 microns. The MEM pump also comprises means for providing a thermal gradient across the porous silicon region along a length of each pore to draw the gas from the inlet chamber through the porous silicon region to the outlet channel.

The means for providing the thermal gradient across the porous silicon region can comprise an electrical resistance heater located in the outlet chamber to heat the porous silicon region on the second major surface of the silicon substrate. Alternately, the means for providing the thermal gradient across the porous silicon region can comprise an integrated circuit in thermal communication with the porous silicon region on the second major surface of the silicon substrate.

The present invention also relates to a MEM pump for pumping a gas which comprises a silicon substrate having a pair of major surfaces; a plurality of porous silicon regions formed in the silicon substrate between the pair of major surfaces, with each porous silicon region further comprising an inlet end located proximate to one of the major surfaces, an outlet end located proximate to the other major surface, and a plurality of substantially straight pores extending through each porous silicon region between the inlet end and the outlet end. In the MEM pump, each adjacent pair of the porous silicon regions can be interconnected by a flow channel which extends through the silicon substrate from the outlet end of one porous silicon region of the pair to the inlet end of the other porous silicon region of the pair. An electrical resistance heater is located proximate to the outlet end of each of porous silicon region to provide a thermal gradient across that porous silicon region to pump the gas therethrough.

The pores in each porous silicon region can have a cross-section dimension which is substantially equal to or smaller than a mean free path of molecules of the gas being pumped through that porous silicon region. The pores in one or more of the porous silicon regions can also have a cross-section size which is different from the cross-section size of the pores in another of the porous silicon regions. By providing different pore sizes for the various pump stages, each pump stage can be optimized for an expected gas pressure therein.

Each electrical resistance heater can be disposed on a lid which is attached to the major surface of the silicon substrate wherein the outlet end of each porous silicon region is located. Alternately, each electrical resistance heater can be supported on a suspended membrane.

The present invention further relates to a MEM pump for pumping a gas which comprises a plurality of pump stages connected together in series. Each pump stage can comprise an inlet chamber and an outlet chamber separated by a porous silicon region, with the porous silicon region comprising a plurality of pores formed in a silicon substrate. Each pore is substantially straight and has a cross-section size which is substantially equal to or smaller than a mean free path of the gas therein. An electrical resistance heater is located within the outlet chamber of each pump stage to provide a thermal gradient directed along a length of the pores of that pump stage to draw the gas through the pores of that pump stage. Each adjacent pair of the pump stages can be connected together in series by a channel extending from the outlet chamber of a first pump stage of the pair through the silicon substrate to the inlet chamber of a second pump stage of the pair.

Additional advantages and novel features of the invention will become apparent to those skilled in the art upon examination of the following detailed description thereof when considered in conjunction with the accompanying drawings. The advantages of the invention can be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several aspects of the present invention and, together with the description, serve to explain the principles of the invention. The drawings are only for the purpose of illustrating preferred embodiments of the invention and are not to be construed as limiting the invention. In the drawings.

DETAILED DESCRIPTION OF THE INVENTION

Figure 1A:
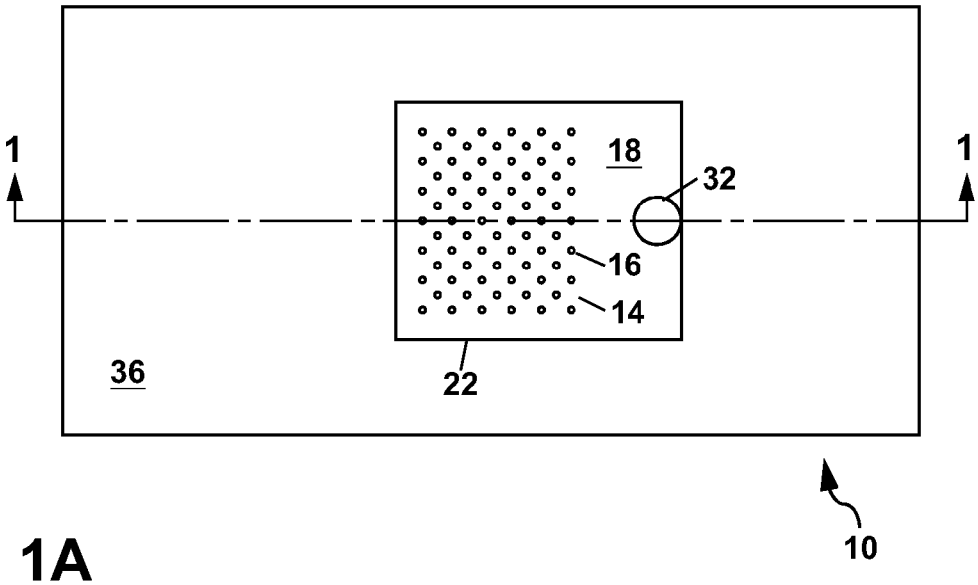
FIG. 1A shows a schematic plan view of a first example of a MEM pump of the present invention with a lid removed to show details a porous silicon region therein.
Figure 1B:
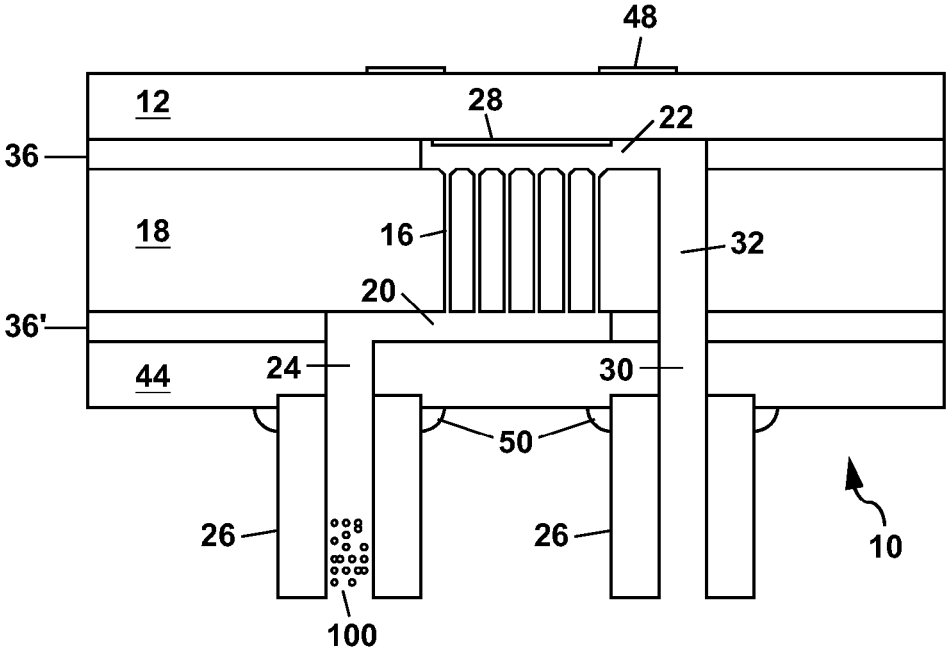
FIG. 1B shows a schematic cross-section view of the MEM pump of FIG. 1A along the section line 1-1 in FIG. 1A.

FIG. 1A shows a schematic plan view of a first example of a microelectromechanical (MEM) pump 10 according to the present invention; and FIG. 1B shows a schematic cross-section view of this device 10 along the section line 1-1 in FIG. 1A. In FIG. 1A, a lid 12 has been omitted from the schematic plan view of the MEM pump 10 in order to show details of the interior of the pump 10 including a porous silicon region 14 which is responsible for providing a thermal transpiration pumping of a gas 100 when a thermal gradient is provided across the porous silicon region 14. The porous silicon region 14 comprises a plurality of substantially straight pores 16 which are etched through a silicon substrate 18, with the pores 16 all being of substantially the same size, and with a cross-section dimension of the pores 16 that generally ranges from about 10 nanometers (nm) to about 10 microns (μm) depending upon a pressure of the gas 100 in the MEM pump 10.

By forming the pores 16 substantially perpendicular to the silicon substrate 18 as shown in FIGS. 1A and 1B, a large number of pores 16 can be provided in a relatively small space in the MEM pump 10. This can save a significant amount of space, especially when a number of MEM pumps 10 are to be formed on a common substrate (e.g. as a multi-stage MEM pump). This configuration with the pores 16 substantially perpendicular to the silicon substrate 18 can also provide a relatively high flow rate since the pores 16 can be closely packed together.

In the MEM pump 10 of FIGS. 1A and 1B, an inlet chamber 20 is located on one side of the porous silicon region 14 as shown in FIG. 1B; and an outlet chamber 22 is located on the other side of the porous silicon region 14. The gas 100 being pumped can be admitted into the inlet chamber 20 through an inlet port 24 which can be open to the ambient, or connected to tubing 26 as shown in FIG. 1B. The gas 100 is drawn into an inlet side of the porous silicon region 14 which forms one wall of the inlet chamber 20.

Since the pores 16 have a cross-section dimension (i.e. a diameter or width) which can be about equal to or smaller than a mean free path of the molecules of the gas 100, molecule-to-wall interactions will dominate the flow of the gas 100 in the pores 16. In this so-called free molecular regime, a thermal transpiration pumping (also termed thermal creep) of the gas 100 will occur when a thermal gradient is provided along the length of the pores 16. If the size of the pores 16 is increased to larger than the mean free path of the molecules of the gas 100, the gas flow will transition to viscous dominated molecule-to-molecule interactions, and a thermal creep portion of the gas flow will decrease. Such viscous dominated molecule-to-molecule interactions are characteristic of the inlet and outlet chambers 20 and 22 which have dimensions much larger than the mean free path of the gas 100.

In the MEM pump 10 of FIGS. 1A and 1B, an electrical resistance heater 28 is provided in the outlet chamber 22 to heat an outlet side of the porous silicon region 14 which forms one wall of the outlet chamber 22. This establishes a thermal gradient along the length of the pores 16 due to a temperature difference between the inlet and outlet sides of the porous silicon region 14 which draws the gas 100 through the pores 16 from the inlet chamber 20 to the outlet chamber 22. In a closed system, the relation between temperature and pressure in the inlet and outlet chambers 20 and 22, respectively, is given by:

$$\frac{P_2}{P_1} = \sqrt{\frac{T_2}{T_1}}$$

where $P_1$ and $T_1$ are the pressure and temperature in the inlet chamber 20, and $P_2$ and $T_2$ are the pressure and temperature in the outlet chamber 22. Thus, the pumping of the gas 100 from the inlet chamber 20 into the outlet chamber 22 depends on the absolute temperatures $T_1$ and $T_2$ of the gas 100 in these two chambers. The temperature $T_2$ in the outlet chamber 22 can be, for example, up to a few hundred degrees Kelvin (e.g. 400-600° K); and the temperature $T_1$ in the inlet chamber 20 can be, for example, about room temperature (e.g. 300° K). This allows the MEM pump 10 to be operated as a vacuum pump, or as a compressor, or both depending upon how connections are made to the chambers 20 and 22. When used as a vacuum pump, the MEM pump 10 can evacuate the gas 100 from an external chamber which is connected by the tubing 26 to the inlet port 24, or from the input chamber 20 when the inlet port 24 is sealed. When used as a compressor, the MEM pump 10 can provide an increased pressure of the gas 100 at an outlet port 30 which is shown connected to additional tubing 26 in FIG. 1B. The MEM pump 10 can also be used to draw the gas 100 through a MEM chemical analysis system to detect one or more chemical species of interest in the gas 100.

In the example of FIGS. 1A and 1B, the outlet port 30 is located on the same side of the silicon substrate 18 as the inlet port 24 by providing a channel 32 through the silicon substrate 18, with the channel 32 generally being located outside the porous silicon region 14. The cross-section size of the channel 32, which can be circular, rectangular or any arbitrary shape, is much larger than that of each pore 16 so that viscous dominated molecule-to-molecule interactions will occur in the channel 32.

The provision of the inlet and outlet ports 24 and 30 on the same side of the silicon substrate 18 facilitates making external connections to the MEM pump 10 through tubing 26 as shown in FIG. 1B. It also facilitates packaging of the MEM pump 10 and facilitates coupling of the MEM pump 10 to other MEM devices which can be formed separately or on the same silicon substrate 18. Additionally, by providing the inlet and outlet ports 24 and 30 on the same side of the silicon substrate 18, multiple MEM pumps 10 can be fabricated on a common silicon substrate 18 and connected together in series to form a multi-stage MEM pump (see FIGS. 4A and 4B).

Fabrication of the MEM pump 10 of FIGS. 1A and 1B will now be described with reference to FIGS. 2A-2K which show a series of schematic cross-section views that illustrate different steps in the formation of the MEM pump 10. Only the essential steps of the fabrication process will be described herein. Those skilled in the art will understand that many additional process steps are required which are well known in the micromachining art, including photolithographic mask design and fabrication, substrate cleaning steps, photolithographic mask exposure, development and stripping, impurity dopant diffusion, material deposition, device packaging, etc.

Figure 2A:
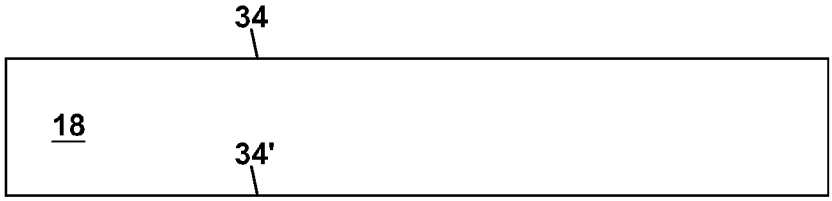
FIGS. 2A-2K show schematic cross-section views to illustration of fabrication of the MEM pump of FIGS. 1A and 1B.

In FIG. 2A, a <100>-oriented monocrystalline silicon substrate 18 is provided which comprises an upper major surface 34 (also referred to herein as an upper surface 34) and a lower major surface 34' (also referred to herein as a lower surface 34'). The silicon substrate 18 is preferably lightly n-type doped (e.g. with phosphorous) with the exact doping level depending upon the cross-section size of the pores 16 to be formed in the substrate 18. Generally, the cross-section size or diameter of the pores 16 in microns will be approximately equal to a resistivity of the silicon substrate 18 as measured in units of Ohm-centimeters (Ω-cm).

Figure 2B:
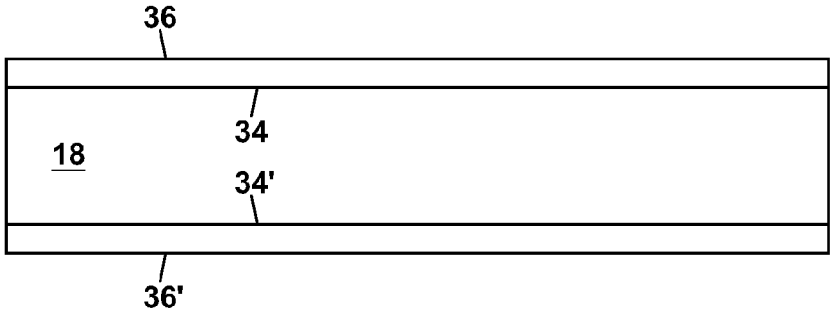

In FIG. 2B, layers 36 and 36' of silicon nitride are blanket deposited over the two major surfaces 34 and 34' of the silicon substrate 18. The silicon nitride can be conformally deposited over the entire substrate 18 to a layer thickness of, for example, up to about 1-2 μm. This can be done by low-pressure chemical vapor deposition (LPCVD) at a substrate temperature of about 850° C.

Figure 2C:
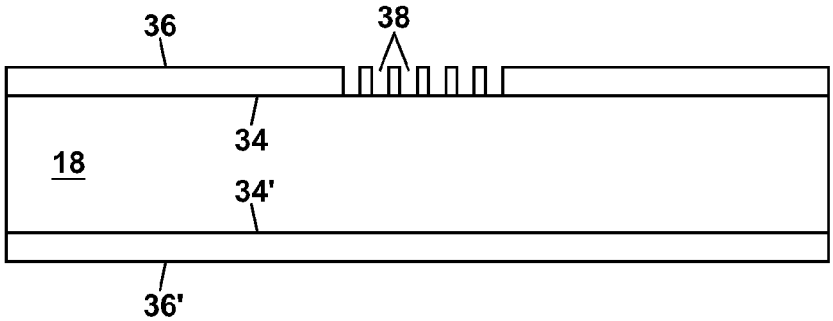

In FIG. 2C, a plurality of generally micron-sized openings 38 can be formed through the silicon nitride layer 36 at the locations where the pores 16 are to be formed. This can be done by providing a photolithographically-defined etch mask over the silicon nitride layer 36 and then etching down through the layer 36 using reactive ion etching to expose the underlying upper surface 34 of the silicon substrate 18. Although only a few openings 38 are shown in FIG. 2C, those skilled in the art will understand that up to thousands or more individual openings 38 can be formed, with the exact number of openings 38 depending upon the size and spacing of the pores 16 being formed to define the porous silicon region 14 of the silicon substrate 18. The openings 38 can be round or square, or arbitrary shaped.

Figure 2D:
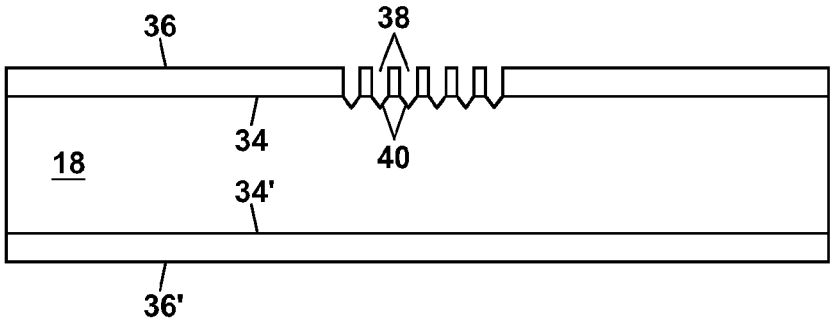

In FIG. 2D, an etch pit 40 is formed in the silicon substrate 18 at the location of each opening 38. This can be done by exposing the upper surface 34 of the silicon substrate 18 to an anisotropic etchant such as potassium hydroxide (KOH) which preferentially etches the silicon, with the etching being terminated at <111> crystalline planes of the silicon which intersect to form an inverted pyramid structure for each etch pit 40. The bottom of the etch pits 40 will define the locations where each pore 16 will be subsequently formed.

Figure 2E:
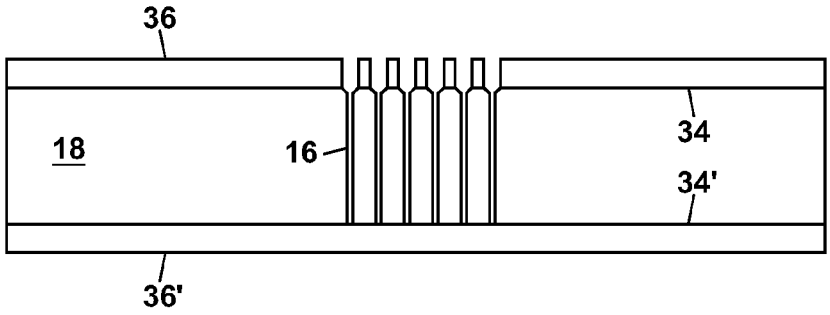

In FIG. 2E, the pores 16 can be formed by an anodic dissolution process whereby the silicon is anodized by a hydrofluoric acid (HF) electrolyte. The anodic dissolution process can be performed by exposing the etch pits 40 to the HF electrolyte with an electrical current being applied to the silicon substrate 18 using a potentiostat. The silicon substrate 18 can be used as an anode, and a counter electrode can be provided in the HF electrolyte. The current density from the potentiostat can be, for example, up to about 30 milliAmps per square centimeter, at a voltage of up to about 10 Volts. A backside illumination of the lower surface 34' can be provided with a lamp during the anodic dissolution process. The illumination from the lamp can be, for example, about 100 milliWatts per square centimeter of white light. Filtering of the white light with a high pass filter is useful to limit a penetration depth of the light into the silicon substrate 18 so that minority charge carriers (i.e. holes) generated by the backside illumination are produced away from the etch pits 40 and are then transported to the location of the etch pits 40 by the electrical current. This helps to limit the formation of the pores 16 to the location of the etch pits 40, to form the pores 16 with a uniform width, and to prevent anodic dissolution of the silicon between the pores 16.

The holes produced by the backside illumination of the silicon substrate 18 are necessary for the anodic dissolution of silicon to form the pores 16. The holes are transported to the etch pits 40 by the electrical current, with the etch pits 40 acting as nucleation centers for the growth of the pores 16 downward in the substrate 18. In addition to adjusting the n-type doping of the silicon substrate 18 to control the cross-section size of the pores 16, the cross-section size of the pores 16 can also be adjusted by controlling the current density provided by the potentiostat. In general, to form smaller size pores 16, a smaller current density can be used. The pores 16 in the MEM pump 10 of FIGS. 1A and 1B can have a pore size (i.e. a diameter or cross-section dimension of the pores 16) that is generally in the range of 10 nm to 10 μm, with the exact pore size being determined by the pressure of the gas 100 which will be pumped. As an example, the pore size can be about 60 nm when the gas 100 is at atmospheric pressure; and the pore size can increase from this value when the pressure of the gas 100 being pumped is reduced. The anodic dissolution process step can proceed until the pores 16 have been formed through the silicon substrate 18 to a predetermined depth, or entirely through the substrate 18 which can be, for example, about 500 μm thick. A growth rate of the pores 16 can be on the order of about 1 μm per minute.

Further details of the anodic dissolution process, which is well known in the art, can be found in U.S. Pat. No. 5,360,759; and in an article by S. Ottow et al. entitled "Processing of Three-Dimensional Microstructures Using Macroporous n-Type Silicon," published in the *Journal of the Electrochemical Society*, vol. 143, pp. 385-390, January 1996; and in another article by V. Lehmann entitled "Porous Silicon—A New Material for MEMS" published in the *Proceedings of the Ninth Annual International Workshop on Micro Electro Mechanical Systems, MEMS* '96, pp. 1-6, February 1996. Each of these references is incorporated herein by reference.

Figure 2F:
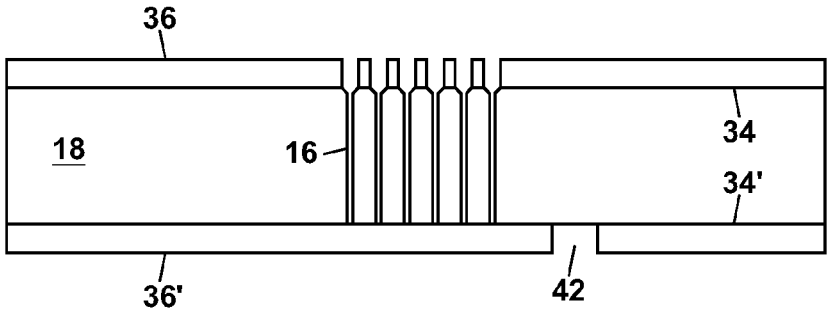

In FIG. 2F, once the porous silicon region 14 containing the pores 16 has been formed, another opening 42 can be etched through the silicon nitride layer 36' to expose the lower surface 34' of the silicon substrate 18. This can be done using reactive ion etching with a photolithographically-defined etch mask (not shown). The etch mask can comprise photoresist, or can be a hard etch mask formed of a silicate glass such as TEOS which can be deposited from the decomposition of tetraethylortho silicate by LPCVD at a temperature of about 750° C. and densified by a high temperature processing step.

Figure 2G:
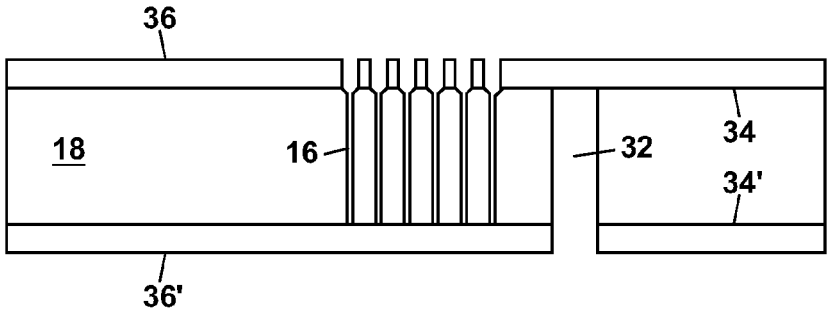

In FIG. 2G, the channel 32 can be formed through the silicon substrate 18 using a deep reactive ion etch (DRIE) process such as that disclosed in U.S. Pat. No. 5,501,893 to Laermer, which is incorporated herein by reference. The DRIE process utilizes an iterative Inductively Coupled Plasma (ICP) deposition and etch cycle wherein a polymer etch inhibitor is conformally deposited as a film over an exposed portion of the lower surface 34' of the silicon substrate 18 during a deposition cycle, and is then subsequently removed during an etching cycle. The polymer film, which is formed in a $C_4F_8$/Ar-based plasma, deposits conformally over the sidewalls of the channel 32 being etched. During a subsequent etch cycle using an $SF_6$/Ar-based plasma, the polymer film can be preferentially sputtered from the channel 32 being formed so that the silicon can be etched by reactive fluorine atoms from the $SF_6$/Ar-based plasma. After the polymer at the bottom of the channel 32 being formed has been sputtered away and a portion of the silicon at the bottom of the channel 32 has been etched, but before the polymer on the sidewalls of the channel 32 has been completely removed, the polymer deposition step using the $C_4F_8$/Ar-based plasma can be repeated. This cycle can continue until the channel 32 has been etched completely through the silicon substrate 18 as shown in FIG. 2G. Each polymer deposition and etch cycle generally lasts but a few seconds (e.g. up to 10 seconds). The net result is that the channel 32 can be etched completely through the silicon substrate 18 while maintaining substantially straight sidewalls. \

Although the channel 32 is shown in FIG. 1A as having a circular cross-section shape, the channel 32 can alternately be polygonal or any arbitrary shape. A channel 32 with a circular cross-section shape is useful for coupling to cylindrical tubing 26 as shown in FIG. 1B; whereas other cross-section shapes (e.g. square or rectangular) for the channel 32 may be better suited for MEM pumps 10 formed integrally with other types of MEM devices, or when a multi-stage MEM pump is formed. The cross-sectional area of the channel 32 will generally be on the order of the total cross-sectional size of all the pores 16 or larger. As an example, the channel 32 can have a cross-sectional dimension in the range of 10-200 μm.

Figure 2H:
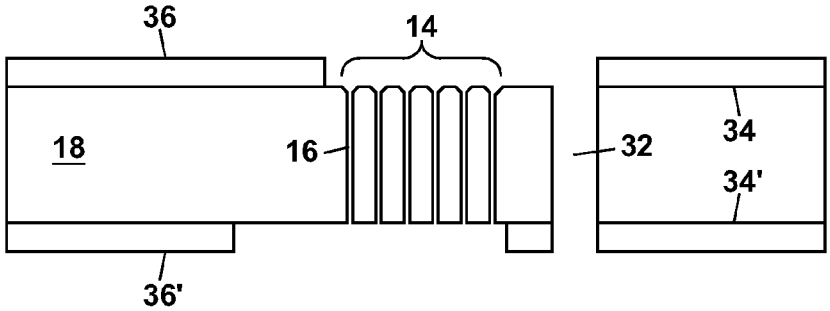

In FIG. 2H, the silicon nitride layers 36 and 36' can be removed to expose each side of the porous silicon region 14 and to begin to form the inlet chamber 20 and the outlet chamber 22. This can be done using a reactive ion etching step with a photolithographically-defined etch mask (not shown). If needed, additional layers of silicon nitride or silicon dioxide can be deposited over the substrate 18 to further build up the thickness of the inlet chamber 20 or the outlet chamber 22.

Figure 2I:
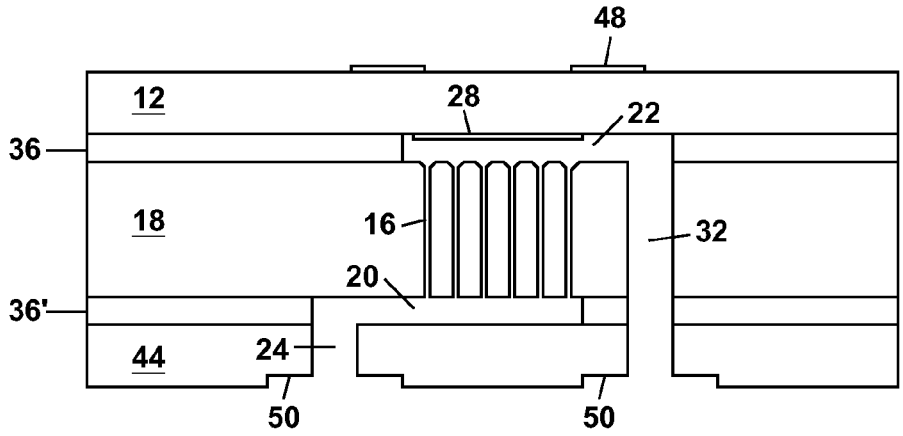

In FIG. 2I, a lid 12 can be provided overtop the silicon substrate 18 to complete the outlet chamber 22; and a base 44 can be provided underneath the substrate 18 to complete the inlet chamber 20. The lid 12 and base 44 can comprise, for example, glass, ceramic or silicon which can be permanently attached to the silicon substrate 18 with an adhesive, or by anodic bonding.

The lid 12 can include an electrical resistance heater 28 which can be deposited on a bottom surface of the lid 12 (see FIGS. 3A and 3B) so that the electrical resistance heater 28 will be located inside the outlet chamber 22 directly above the porous silicon region 14 to heat the outlet end thereof in order to provide the thermal gradient along the length of the pores 16 which is needed to pump the gas 100 through the pores 16. Vias 46 (e.g. comprising a deposited, plated, or sintered metal such as gold, silver, copper, tungsten, platinum, aluminum, etc.) can be provided through the lid 12 to connect the electrical resistance heater 28 to a pair of contact pads 48 on a top surface of the lid 12. This allows the electrical resistance heater 28 to be connected to an external power supply (not shown). The contact pads 48 on the top surface of the lid 12 can also be used to flip-chip bond the MEM pump 10 to a package having a plurality of electrical pins for making electrical connections to the MEM pump 10.

Figure 3A:
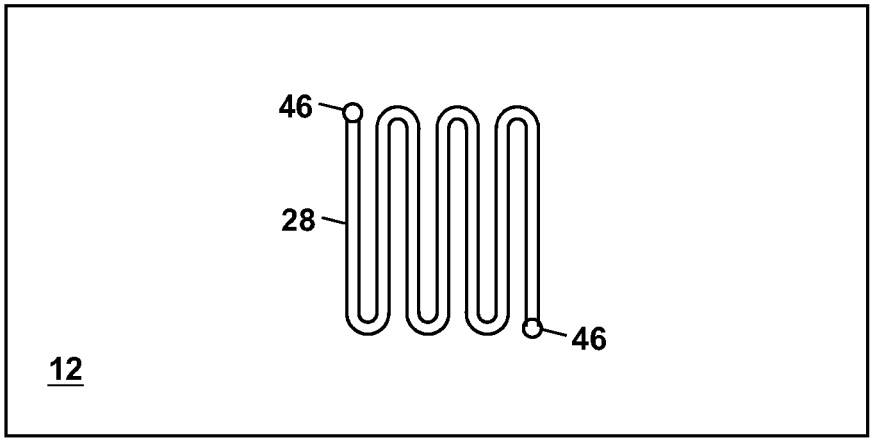
FIG. 3A shows a schematic plan view of a bottom surface of a lid with a serpentine electrical resistance heater formed thereon.
Figure 3B:
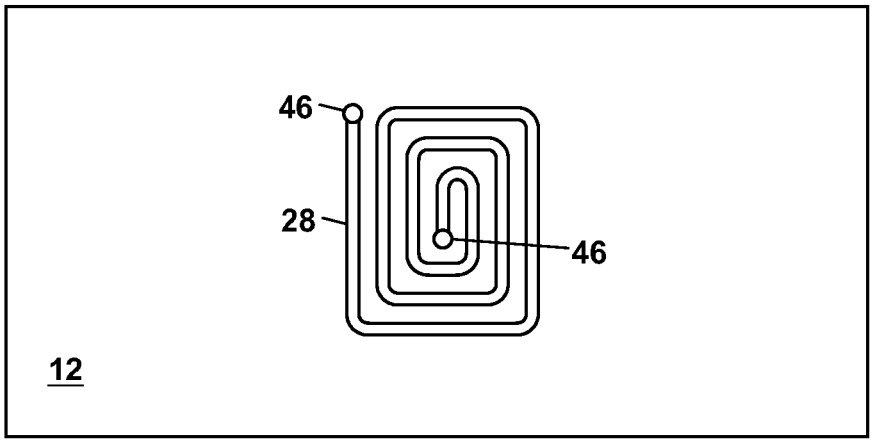
FIG. 3B shows a schematic plan view of the bottom surface of the lid with a spiral electrical resistance heater.

The electrical resistance heater 28 can have a serpentine or spiral shape as shown in the schematic plan views of the bottom surface of the lid 12 in FIGS. 3A and 3B. The electrical resistance heater 28 can comprise a metal such as gold, platinum, tungsten, nickel-chromium (also termed nichrome), or alternately a semiconductor such as doped polysilicon. The material used to form the electrical resistance heater 28 can be deposited over the bottom surface of the lid 12 by evaporation, sputtering or chemical vapor deposition (CVD) and then patterned by etching or liftoff. The electrical power required to operate the heater 28 will, in general, depend upon the size of the heater 28 and the porous silicon region 14 and can be, for example, on the order of 100 milliWatts or less.

Figure 2J:
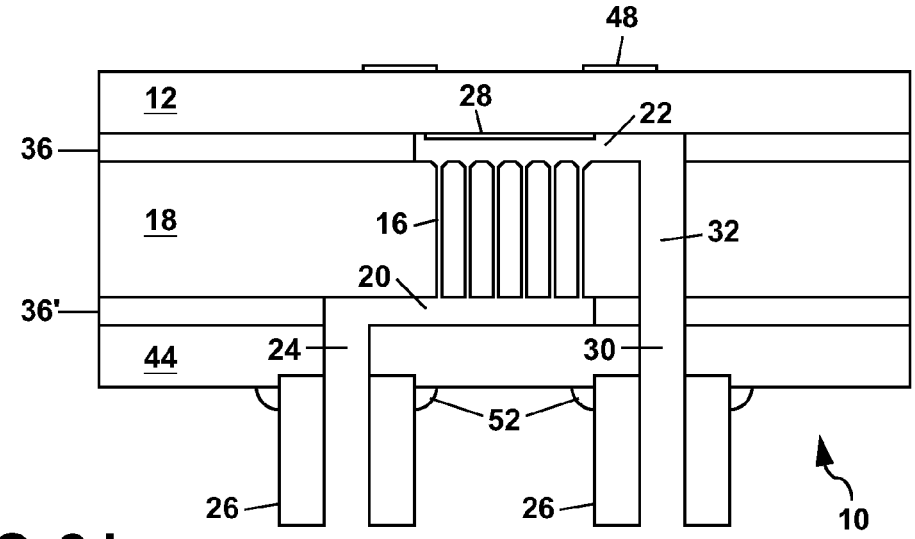

Returning to FIG. 2I, the base 44 can include openings for the inlet port 24 and the outlet port 30 which can be formed, for example, by etching or laser drilling. Optionally, the base 44 can include a recessed region 50 formed about each port 24 and 30 to facilitate positioning tubing 26 at these ports 24 and 30. Once the tubing 26 is positioned in place in the recessed region 50, the tubing 26 can then be permanently attached with an adhesive 52 (e.g. a UV-cured epoxy, or a silicon adhesive such as polydimethyl siloxane also referred to as PDMS) as shown in FIG. 2J. The adhesive 52 can be optionally built up around the tubing 26 to a predetermined layer thickness to strengthen the bond of the tubing 26 to the base 44. This completes the fabrication of the MEM pump 10 of FIGS. 1A and 1B.

Figure 2K:
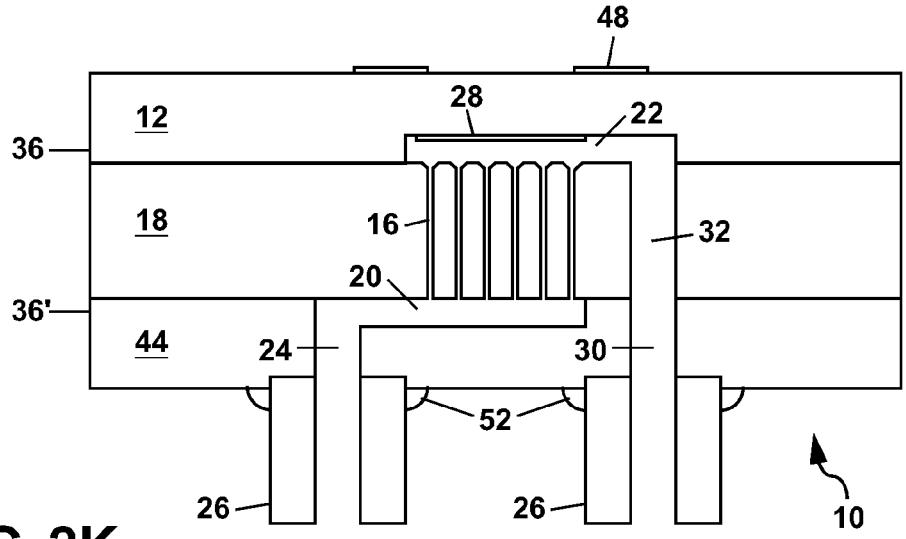

In other embodiments of the present invention (see FIG. 2K), the silicon nitride layers 36 and 36' can be completely removed after the step of FIG. 2G, and the lid 12 and base 44 can be provided with molded or etched recesses which form the inlet chamber 20 and the outlet chamber 22 so that anodic bonding can be used to attach the lid 12 and base 44 to the silicon substrate 18. In these embodiments of the present invention, the electrical resistance heater 28 can be located in the recess in the lid 12 as shown in FIG. 2K and connected by electrical vias formed through the lid 12 to contact pads 48 on the top surface of the lid 12.

Removing the silicon nitride layers 36 and 36' after the step of FIG. 2G can also allow the pores 16 to be oxidized to form a lining of silicon dioxide therein and also to form a silicon dioxide region between the pores 16 on both of the major surfaces 34 and 34' of the silicon substrate 18. This is useful to reduce the thermal conductivity of the porous silicon region 14 so that a larger thermal gradient can be generated across the porous silicon region 14 for a given amount of heating.

The silicon dioxide lining can be formed from the silicon in the pores 16 by oxidizing the silicon and thereby converting it into silicon dioxide. This can be done by a conventional thermal oxidation process in which the silicon substrate 18 is heated to a high temperature in the range of 800-1200° C. in an oxygen or steam ambient, at ambient pressure or higher. The extent of conversion of the silicon surrounding the pores 16 into silicon dioxide will depend upon the exact time, temperature and pressure used for the thermal oxidation process. In some cases, the porous silicon region 14 can be completely converted into silicon dioxide. Thus, the term "porous silicon region" as used herein also refers to a region wherein the porous silicon has been partially or completely converted into silicon dioxide with the pores 16 retaining their substantially straight shape.

If the porous silicon region 14 is oxidized as described above, this can narrow the cross-sectional size of the pores 16; and this narrowing of the pores 16 must be taken into account to provide pores 16 of a predetermined size in the completed MEM pump 10. The pores 16 can also be narrowed by depositing conformal coating of silicon nitride in the pores 16 and over the major surfaces 34 and 34' of the substrate 18 using LPCVD.

After the thermal oxidation process or deposition of a conformal coating of silicon nitride to narrow the pores 16, the MEM pump 10 can be completed by attaching the lid 12 and base 44 using an adhesive (e.g. epoxy), or by anodic bonding. The lid 12 and base 44 can be recessed as shown in FIG. 2K. Alternately, one or more layers of silicon nitride or silicon dioxide can be deposited over the major surfaces 34 and 34' of the silicon substrate 18 to build up the inlet chamber 20 and the outlet chamber 22 prior to attaching the lid 12 and base 44 in a manner similar to that described with reference to FIG. 2J.

Figure 4A:
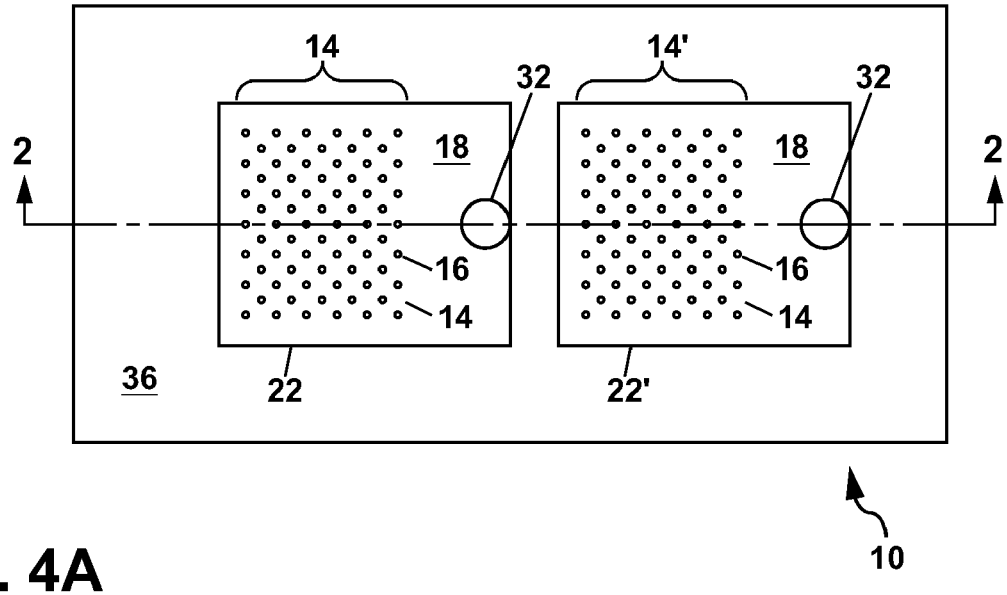
FIG. 4A shows a schematic plan view of a second example of a MEM pump formed according to the present invention with a lid removed to show details of each porous silicon region therein.
Figure 4B:
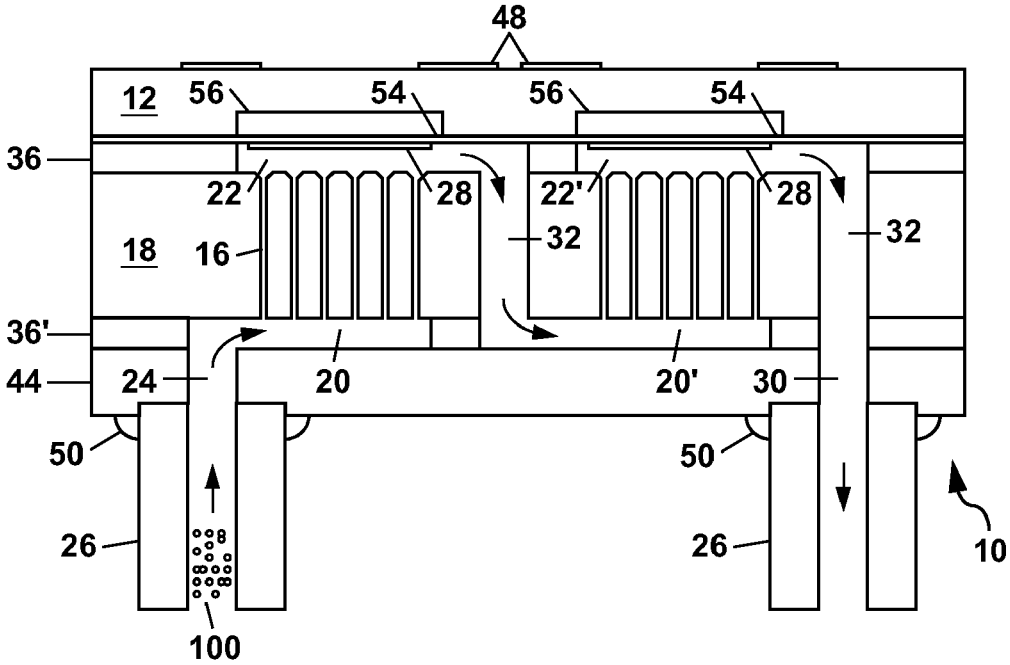
FIG. 4B shows a schematic cross-section view of the MEM pump of FIG. 4A along the section line 2-2 in FIG. 4A.

FIG. 4 shows a second example of a MEM pump 10 formed according to the present invention. In this example, two porous silicon regions 14 and 14' are formed on the same silicon substrate 18 and connected together in series to form a two-stage MEM pump 10. The porous silicon regions 14 and 14' can be simultaneously formed as previously described with reference to FIGS. 2A-2H. The use of two porous silicon regions 14 and 14' allows a larger pressure difference to be developed between the input port 24 and the output port 30. Although the device 10 of FIGS. 4A and 4B shows only two pumping stages (i.e. two porous silicon regions 14), in other embodiments of the present invention additional pumping stages can be added in series to form a multi-stage MEM pump 10 which can include up to one hundred or more pumping stages.

In the example of FIGS. 4A and 4B, the gas 100 is pumped through the MEM pump 10 along a direction indicated by the arrows. The gas 100, upon entering the MEM pump 10, initially flows into a first inlet chamber 20 where the gas 100 is drawn through the pores 16 of a first porous silicon region 14 and into a first outlet chamber 22. The gas 100 then passes through a channel 32 formed through the silicon substrate 18 and into a second inlet chamber 20'. The gas 100 is then drawn through the pores 16 of a second porous silicon region 14' and into a second outlet chamber 22'. The gas 100 then passes through another channel 32 and into the outlet port 30 where the gas 100 exits the MEM pump 10.

In this example of the present invention, an electrical resistance heater 28 for each pumping stage is located on a membrane 54 which is suspended over the porous silicon region 14 or 14' to provide thermal isolation from the lid 12, thereby providing increased heating for a given electrical power input. The membrane 54 can comprise, for example, a layer of silicon nitride or silicon dioxide which can be a fraction of a micron thick (e.g. 0.2-0.5 μm). A blanket deposition of the membrane 54 over the bottom surface of the lid 12 can be performed by LPCVD. The electrical resistance heaters 28 can be blanket deposited over the membrane 54 and patterned by etching or liftoff to form a serpentine or spiral shape as shown in FIGS. 3A and 3B. A cavity 56 can then be etched into the lid 12 to form the suspended membranes 54. This can be done by first etching a plurality of micron-sized openings through the membranes 54 to provide access to the bottom surface of the lid 12 so that a portion of the lid 12 can be etched away to form the cavities 56. When the lid 12 comprises glass or fused silica, the cavities 56 can be etched with a selective etchant comprising HF. When the lid 12 comprises silicon, the cavities 56 can be etched with a selective etchant comprising KOH, or alternately with gaseous xexon difluoride. Each cavity 56 can be, for example, up to about 10 μm deep or more.

In some cases, the cavities 56 can be formed completely through the lid 12 from the top surface thereof. When the lid 12 comprises silicon, for example, a silicon nitride membrane 54 can be blanket deposited over the bottom surface of the silicon lid 12 followed by the deposition and patterning of the electrical resistance heaters 28. A DRIE etch step can then be used as described previously to etch each cavity 56 completely through the silicon lid 12 from the top surface thereof. The open cavities 56 can then be closed, if needed, by attaching a cover (not shown) over the top surface of the lid 12. The cover can comprise a glass or ceramic plate which can be attached to the lid 12 with an adhesive (e.g. epoxy), or by anodic bonding. When the cavities 56 are closed with a cover, a plurality of micron-sized openings can be optionally formed through the membrane 54 at the location of each cavity 56 to equalize the pressure between each cavity 56 and the adjacent output chamber 22 or 22'.

Electrical connections to the heater 28 can be made using vias 46 through the lid 12 with contact pads 48 being formed on the top surface of the lid 12 as described previously. When the lid 12 comprises silicon, the vias 46 and contact pads 48 can be electrically insulated from the silicon lid 12 by forming a thermal oxide layer over the surfaces 34 and 34' of the silicon lid 12 and in the openings wherein the vias 46 are formed by depositing, plating, or sintering metal.

In other embodiments of the present invention, each cavity 56 can be etched or molded into the lid 12 and then filled in with a sacrificial material (e.g. polycrystalline silicon when the lid 12 comprises a glass or ceramic; or silicon dioxide, a silicate glass such as TEOS, or a spin-on glass when the lid 12 comprises silicon). The bottom surface of the lid 12 can then be planarized, if needed, with a polishing step (e.g. a CMP step). The membrane 54 and the electrical resistance heater 28 can then be deposited over the bottom surface of the lid 12, with the heater 28 being patterned by liftoff or etching. The sacrificial material can then be removed with a selective etchant through a plurality of micron-sized openings which can be reactive ion etched through each membrane 54. The selective etchant can comprise xenon difluoride or KOH when a polycrystalline silicon sacrificial material is used, or can comprise hydrofluoric acid (HF) when the sacrificial material comprises silicon dioxide, silicate glass or a spin-on glass. External electrical connections to the heater 28 can be made through contact pads 48 on the top surface of the lid 12 and vias 46 through the lid 12.

In yet other embodiments of the present invention, each membrane 54 and electrical resistance heater 28 can be formed on the layer 36 of silicon nitride. This can be done, for example, after completion of each porous silicon region as previously described with reference to FIG. 2F and after etching each channel 32 almost entirely through the silicon substrate 18 except for a thin top portion which can be up to a few microns thick. The silicon nitride layer 36 overtop each porous silicon region 14 and 14' and overtop each almost-completed channel 32 can be removed by a reactive ion etching step. Then a sacrificial material such as silicon dioxide, a silicate glass such as TEOS, or a spin-on glass can be deposited over each porous silicon region 14 and 14' and over the thin top portion of each channel 32. If needed, a CMP step can be used to planarize the sacrificial material to the level of the silicon nitride layer 36. The electrical resistance heaters 28 can be deposited overtop the sacrificial material and patterned by etching or liftoff. A silicon nitride layer forming the membranes 54 can then be blanket deposited over the silicon nitride layer 36 and over the sacrificial material and heaters 28. Alternately, the electrical resistance heaters 28 can be deposited and patterned overtop the silicon nitride layer forming the membranes 54.

Electrical connections to the heaters 28 can be made through wiring which can be deposited at the same time as the heaters 28. The wiring can be connected to vias 46 in the lid 12, or to contact pads formed on the silicon nitride layer 36, or to electronic circuitry formed on the silicon substrate 18.

A plurality of micron-sized openings can then be etched down through the membranes 54 to provide access to the underlying sacrificial material which can then be removed using a selective etchant (e.g. comprising HF). A DRIE etch step can then be performed from the bottom of the silicon substrate 18 to complete each channel 32 so that each channel 32 opens into the outlet chambers 22 or 22'. A lid 12 having a cavity 56 formed therein at the location of each heater 28 can then be attached (e.g. with epoxy) over the silicon nitride layer which forms the membranes 54.

In the example of FIGS. 4A and 4B, the pores 16 in each porous silicon region 14 and 14' can be of substantially the same size which is preferably substantially equal to or smaller than the mean free path of the gas 100 in each set of pores 16. In other embodiments of the present invention where a number of porous silicon regions 14 are provided connected together in series to form a multi-stage MEM pump 10, the pore size can be different for different of the porous silicon regions 14.

To form different pore sizes in different porous silicon regions 14, dopant diffusion can be used to selectively dope regions of the silicon substrate 18 to different dopant levels using thermal diffusion of an impurity dopant deposited on one or both major surfaces 34 and 34' of the substrate 18. The dopant diffusion can extend partially or completely through the silicon substrate 18. When the dopant diffusion extends only partially through the silicon substrate 18 so that a diffusion-doped thickness of the substrate 18 has a different doping level from the remainder of the thickness of the substrate 18, the pores 16 in the diffusion-doped thickness can have a cross-section dimension which is different from the cross-section dimension for the remainder of the thickness of the substrate 18. When the dopant diffusion extends through the entire thickness of the silicon substrate 18, the pores 16 will have a substantially uniform cross-section dimension.

The locations where the pores 16 are formed by anodic etching can be defined using etch pits 40 as previously described. The different size pores 16 in different diffusion-doped regions of the substrate 18 can be simultaneously formed in a manner similar to that previously described with reference to FIGS. 2A-2E.

To account for different rates of anodic etching of different size pores 16, the upper surface 34 of the substrate 18 can be masked off, for example, in certain regions to limit the anodic etching while the anodic etching proceeds in other regions. Alternately, the lower surface 34' of the substrate 18 can be masked off to control the amount of backside illumination reaching certain regions of the substrate 18 to limit the anodic etching of these regions while the anodic etching proceeds in the other regions.

As yet another example, the anodic etching can be allowed to proceed simultaneously for each differently-doped porous silicon region 14 being formed. If this results in different etch depths for the different sized pores 16, then the substrate 18 can be polished or etched on the lower surface 34' to a depth which is sufficient to open up all the pores 16 in each porous silicon region 14. The lower surface 34' of the substrate 18 can be polished by a CMP step; whereas etching of the lower surface 34' can be performed by DRIE, or by a KOH etch step. Multiple DRIE steps can be used to etch completely through the substrate 18 to form the channels 32 and also to etch to varying depths as needed to open up the pores 16 in each differently-doped porous silicon region 14.

Figure 5:
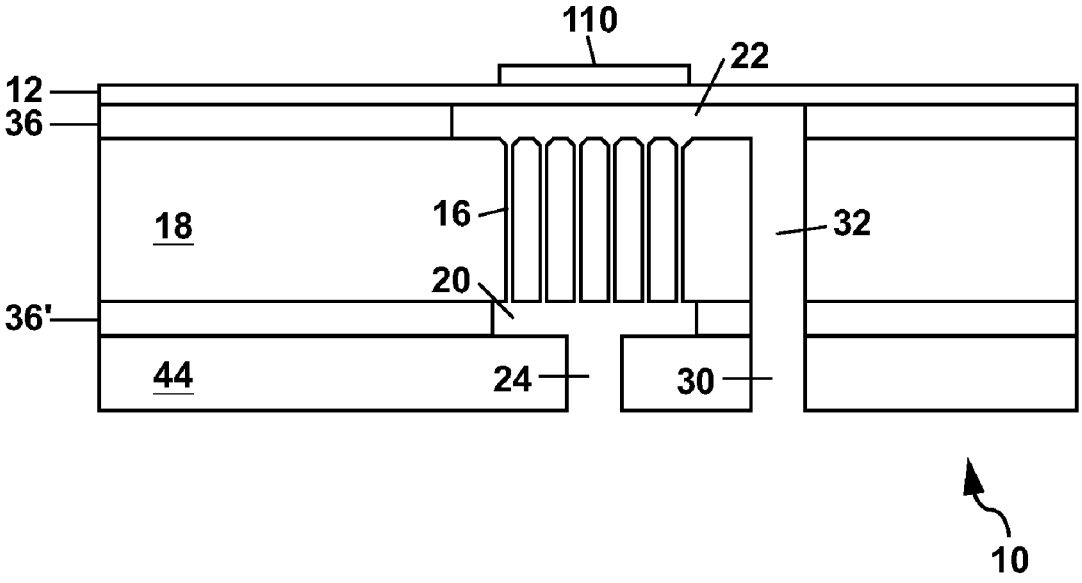
FIG. 5 shows a schematic cross-section view of a third example of a MEM pump powered by heat from an integrated circuit (IC).

FIG. 5 shows a schematic cross-section view of a third example of a MEM pump 10 according to the present invention. The device 10 of FIG. 5 is similar to the MEM pump 10 of FIGS. 1A and 1B except that no electrical resistance heater 28 is provided in the device 10 of FIG. 5. In FIG. 5, the thermal gradient necessary to pump the gas 100 through the MEM pump 10 is provided by an integrated circuit (IC) 110 which is located on top of the lid 12 which can comprise, for example, ceramic, silicon or metal. In some embodiments of the present invention, a silicon or silicon-on-insulator substrate wherein the IC 110 is formed can be used as the lid 12 for the MEM pump 10.

The IC 110 generates heat which can be utilized to drive the MEM pump 10 by heating the outlet side of the porous silicon region 14. This heat from the IC 110 provides the thermal gradient along the length of each pore 16 which is necessary to draw the gas 100 through pores 16 of the MEM pump 10 so that the gas 100 flows from the inlet port 24 to the outlet port 30. The gas 100, which can be air, helium, or any other gas, also provides the beneficial effect of cooling the IC 110 as the waste heat from the IC 110 is transferred to the gas 100 upon passing through the pores 16 and outlet chamber 22, with the heated gas 100 then being expelled through the outlet port 30. The inlet side of the porous silicon region 14 can be in thermal contact with a heat sink which can form the base 44 of the MEM pump 10. A closed-cycle cooling system can also be formed using the MEM pump 10 in FIG. 5, with the heated gas 100 exiting the outlet port 30 and being directed to a heat sink which cools the gas 100 so that the cooled gas 100 can be directed back into the inlet port 24 and recirculated.

Figure 6A:
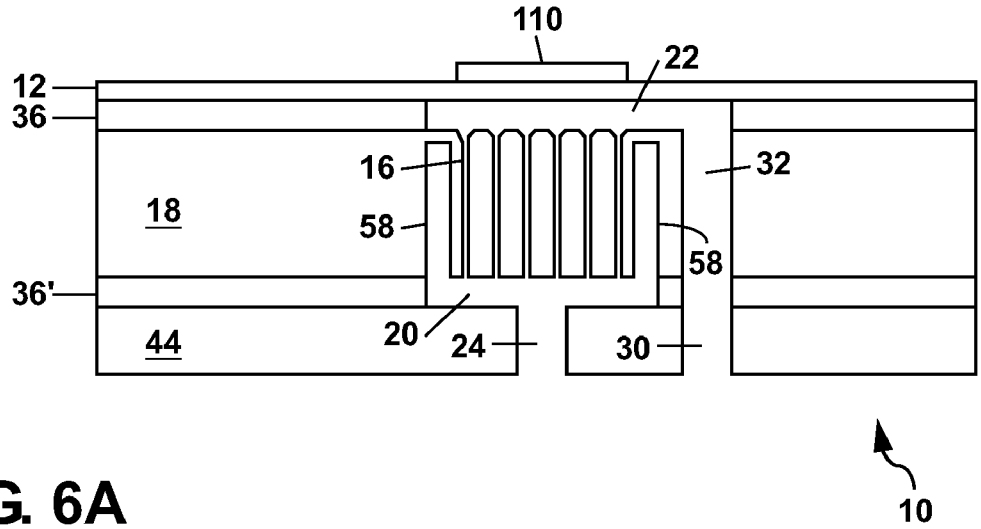
FIGS. 6A and 6B show schematic cross-section views to illustrate the formation of a trench about the porous silicon region to provide thermal isolation from the surrounding silicon substrate.
Figure 6B:
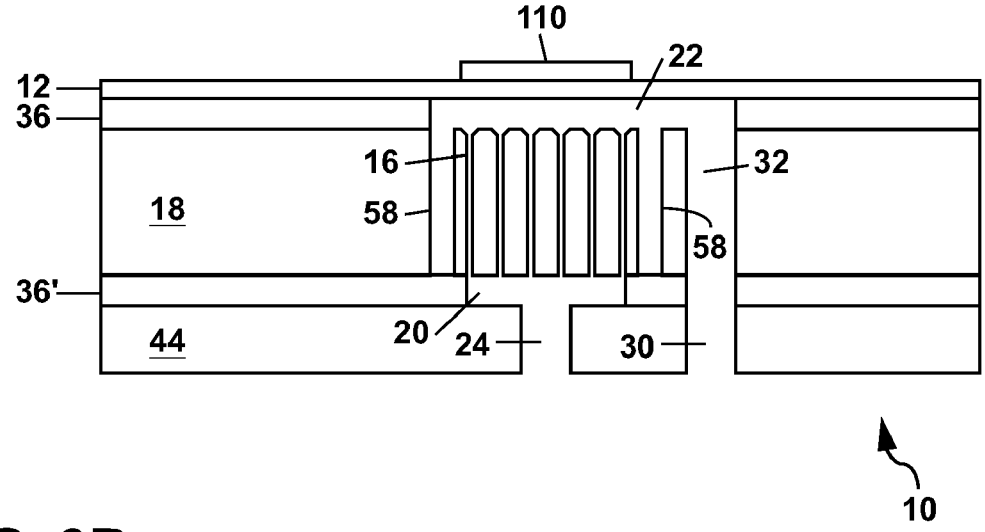

To prevent a direct conduction of the heat from the IC 110 through the silicon substrate 18 and into the porous silicon region 14 which can be detrimental to the establishment of a large thermal gradient along the length of the pores 16, a trench 58 can be formed around the porous silicon region 14 to thermally isolate the porous silicon region 14 from the remainder of the substrate 18. The trench 58, which can be, for example, 10-100 μm wide, can be formed by etching a majority of the way through the silicon substrate 18 from the lower surface 34' thereof as shown in FIG. 6A, or alternately by etching through the majority of the substrate 18 from the upper surface 34 as shown in FIG. 6B. In some cases, such as that shown in FIG. 6B where the silicon nitride layer 36 extends under the trench 58, the trench 58 can be etched completely through the silicon substrate 18.

Etching the trench 58 from the lower surface 34' can be performed by a two-step DRIE process with a shallow DRIE step being used to etch a portion of the channel 32, and with a deep DRIE step then completing the channel 32 and forming the trench 58. Alternately, an etching delay layer as disclosed in U.S. Pat. No. 6,930,051, which is incorporated herein by reference, can be used to retard etching of the trench 58 so that only a single DRIE step is required to etch both the trench 58 and channel 32.

Etching the trench 58 from the upper surface 34 can be performed with a DRIE step prior to forming the porous silicon region 14. The trench 58 can then be filled in or lined with photoresist or silicon nitride prior to the anodic etching step used to form the porous silicon region 14. The photoresist or silicon nitride can then be removed after the anodic etching step forms the pores 16, or can be left in place in the trench 58.

Figure 7:
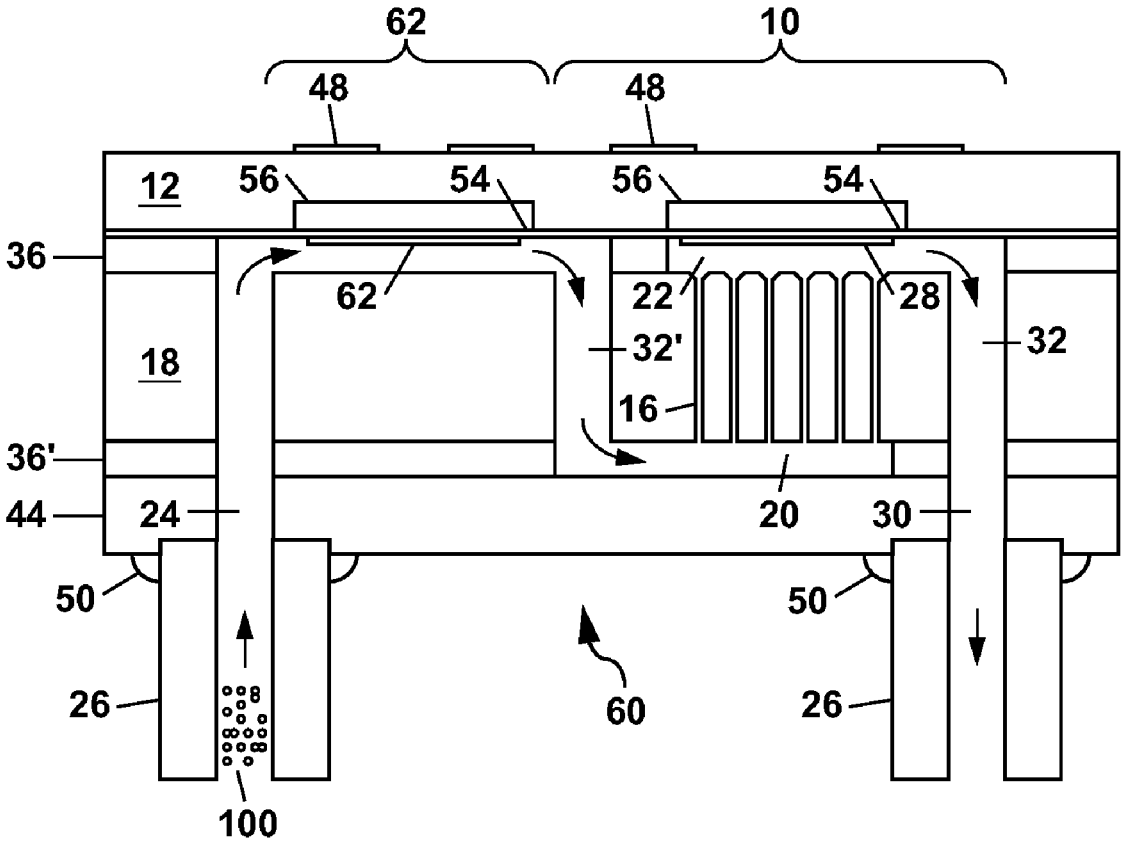
FIG. 7 shows a schematic cross-section view of an example of a MEM chemical analysis system wherein the MEM pump of the present invention is integrated with a chemical preconcentrator.

In other embodiments of the MEM pump 10 of the present invention, one or more additional channels 32 can be formed through the silicon substrate 18 to connect the inlet chamber 20 to the inlet port 24. This can be useful, for example, when the MEM pump 10 is to be integrated into a gas-phase MEM chemical analysis system 60 which can comprise other types of MEM devices known to the art. Such a MEM chemical analysis system 60 can include a chemical preconcentrator 62 as shown in FIG. 7 which can be used to selectively adsorb or absorb and concentrate a particular chemical species of interest from the gas 100 over time, and can then be triggered to suddenly release the chemical species into the gas 100 in a concentrated form (e.g. as a puff). Further details of chemical preconcentrators are disclosed in U.S. Pat. Nos. 6,171,378 and 6,902,701 which are incorporated herein by reference.

FIG. 7 shows a schematic cross-section view of the gas-phase MEM chemical analysis system 60 to illustrate how the MEM pump 10 can be integrated together with other types of MEM devices such as the chemical preconcentrator 62 described above. In the example of FIG. 7, the gas 100 is drawn into the chemical preconcentrator 62 through the entry port 24 and a channel 32 formed through the silicon substrate 18 by action of the MEM pump 10. A chemical species of interest present in the gas 100 is absorbed or adsorbed onto a sorptive coating (e.g. a polymer or sol-gel material) which is disposed over a heating element 64 in the chemical preconcentrator 62. The heating element 64 can comprise a serpentine or spiral electrical resistance heater similar to that previously described with reference to FIGS. 3A, 3B and 4B except that the heating element 64 is operated in a pulsed mode (for generally only a fraction of a second), and has a sorptive coating.

As the MEM pump 10 draws the gas 100 through the chemical preconcentrator 62 over time, the chemical species of interest is selectively concentrated into the sorptive coating. Upon a pulsed heating of the heating element 64 with an electrical current pulse, the chemical species of interest is released in a concentrated puff of gas which is then drawn through the MEM pump 10 and delivered to the output port 30. The chemical preconcentrator 62 and MEM pump 10 can be co-fabricated in a manner similar to that described previously.

Figure 8:
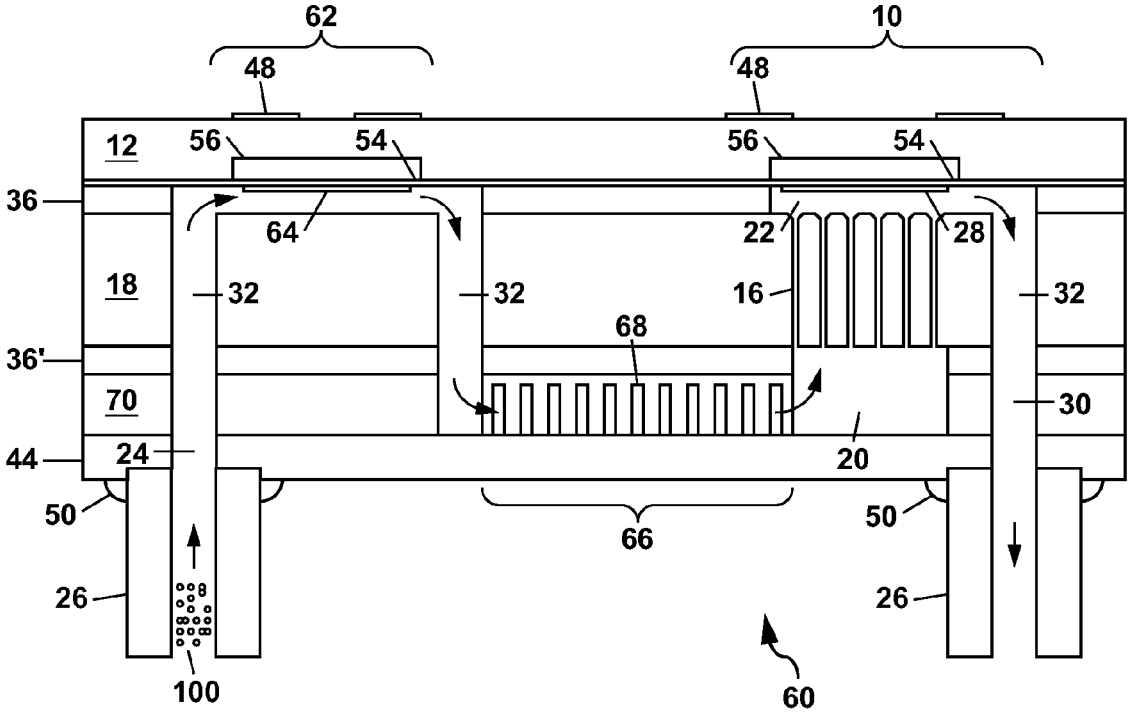
FIG. 8 shows a schematic cross-section view of another example of a MEM chemical analysis system wherein the MEM pump is integrated with a chemical preconcentrator and a gas chromatograph.

Other MEM chemical analysis and detection devices known to the art can be integrated into the gas-phase MEM chemical analysis system 60 as illustrated in the schematic cross-section view of FIG. 8. In this example of the present invention, a MEM gas chromatograph 66 is located between the chemical preconcentrator 62 and the MEM pump 10.

Different chemical species of interest, which can be selectively concentrated with the chemical preconcentrator 62 and subsequently released as a concentrated puff of gas, can be separated in time in the MEM gas chromatograph 66 for detection or chemical analysis. The MEM gas chromatograph 66 can comprise a spiral or serpentine high-aspect-ratio channel 68 which can be etched into a separate glass or silicon substrate 70 by a DRIE step and then coated with a thin polymer stationary phase or packed with a particulate stationary phase. The channel 68 can have an overall length of, for example, up to about one meter.

The gas flow through the MEM chemical analysis system 60 in the example of FIG. 8 is indicated by the arrows. The gas 100 containing one or more chemical species of interest is drawn into the inlet port 24 by action of the MEM pump 10. The gas 100 then enters the chemical preconcentrator 62 where the chemical species of interest are selectively absorbed or adsorbed from the gas 100 over time and concentrated into the sorptive material disposed upon the heating element 64. Upon applying a heating current pulse to the heater 64, the chemical species of interest are suddenly released as a concentrated puff of gas which then passes through the channel 32 in the silicon substrate 18 and into the MEM gas chromatograph 66 where different chemical species of interest are separated in time. Upon exiting the MEM gas chromatograph 66, the different chemical species can be detected with a detector (not shown) which can be located before or after the MEM pump 10. The gas 100 after passing through the MEM pump 10 can then be expelled through the outlet port 30, or directed to an external detector connected to the output port 30 via the tubing 26.

To assemble the MEM chemical analysis system 60 in FIG. 8, the substrate 70 containing the MEM gas chromatograph 66 can be attached to the silicon substrate 18 and the base 44 using an adhesive (e.g. epoxy) or anodic bonding. If the MEM gas chromatograph is fabricated with a spiral channel 68 having a side entry port and a central exit port, a channel (not shown) can be formed in the base 44 or in the layer 36' of silicon nitride to connect the central exit port to the inlet chamber 20 of the MEM pump 10.

The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A microelectromechanical (MEM) pump for pumping a gas, comprising:

an inlet chamber for receiving the gas;

an outlet chamber in thermal communication with a heat source; and a silicon substrate separating the inlet chamber from the outlet chamber, with the silicon substrate comprising a porous silicon region having a plurality of pores which are oriented substantially perpendicular to a first major surface and a second major surface of the silicon substrate and extending between the inlet chamber and the outlet chamber, and with a cross-section dimension of each pore being substantially equal to or smaller than a mean free path length of the gas to pump the gas from the inlet chamber to the outlet chamber in response to a thermal gradient provided along a length of each pore by the heat source, the silicon substrate having a channel formed therethrough to transport the gas from the outlet chamber located on the second major surface of the silicon substrate to the first major surface of the silicon substrate.

2. The MEM pump of claim 1 wherein the heat source comprises an electrical resistance heater.

3. The MEM pump of claim 2 wherein the electrical resistance heater is supported by a lid which forms at least one wall of the outlet chamber.

4. The MEM pump of claim 2 wherein the electrical resistance heater is supported on a suspended membrane.

5. The MEM pump of claim 1 wherein the heat source comprises an integrated circuit in thermal communication with a lid which forms at least one wall of the outlet chamber.

6. The MEM pump of claim 1 wherein the cross-section dimension of the pores is in a range of 10 nanometers to 10 microns.

7. A microelectromechanical (MEM) pump for pumping a gas, comprising:

an inlet port located on one side of a silicon substrate and connected to an inlet chamber for receiving the gas;

an outlet port located on the same side of the silicon substrate and connected to an outlet chamber by a channel formed through the silicon substrate, with the outlet chamber being in thermal communication with a heat source, and with the silicon substrate separating the inlet chamber from the outlet chamber, and with the silicon substrate comprising a porous silicon region having a plurality of pores extending between the inlet chamber and the outlet chamber, and with a cross-section dimension of each pore being substantially equal to or smaller than a mean free path length of the gas to pump the gas from the inlet chamber to the outlet chamber in response to a thermal gradient provided along a length of each pore by the heat source.

8. The MEM pump of claim 7 wherein the inlet chamber is connected to the inlet port by a channel formed through the silicon substrate.

9. A microelectromechanical (MEM) pump for pumping a gas, comprising:

a silicon substrate having a plurality of pores formed therethrough with each pore having a first end in fluid communication with an inlet chamber located on a first major surface of the silicon substrate, and with each pore having a second end in fluid communication with an outlet chamber located on a second major surface of the silicon substrate, and with each pore being substantially straight and aligned substantially perpendicular to the major surfaces of the silicon substrate, and with each pore having a cross-section dimension substantially equal to or less than a mean free path of the gas, and with the silicon substrate having a channel formed therethrough to transport the gas from the outlet chamber to the first major surface of the silicon substrate; and an electrical resistance heater located proximate to the second end to provide a thermal gradient between the first and second ends of each pore to draw the gas through each pore.

10. The MEM pump of claim 9 wherein the cross-section dimension of each pore is in a range of 10 nanometers to 10 microns.

11. The MEM pump of claim 9 wherein the electrical resistance heater is supported on a suspended membrane.

12. The MEM pump of claim 9 wherein the electrical resistance heater is supported by a lid which forms at least one wall of the outlet chamber.

13. A microelectromechanical (MEM) pump for pumping a gas, comprising:

a silicon substrate having a first major surface and a second major surface, with an inlet chamber being formed on the first major surface of the silicon substrate, and with an outlet chamber being formed on the second major surface of the silicon substrate, and with the outlet chamber being in fluid communication with an outlet channel which extends through the silicon substrate to the first major surface thereof;

a porous silicon region formed in the silicon substrate and comprising a plurality of pores extending between the inlet chamber and the outlet chamber, with each pore being substantially straight and having a cross-section dimension in the range of 10 nanometers to 10 microns; and means for providing a thermal gradient across the porous silicon region along a length of each pore to draw the gas from the inlet chamber through the porous silicon region to the outlet channel.

14. The MEM pump of claim 13 wherein the means for providing the thermal gradient across the porous silicon region comprises an electrical resistance heater located in the outlet chamber to heat the porous silicon region on the second major surface of the silicon substrate.

15. The MEM pump of claim 13 wherein the means for providing the thermal gradient across the porous silicon region comprises an integrated circuit in thermal communication with the porous silicon region on the second major surface of the silicon substrate.

16. A microelectromechanical (MEM) pump for pumping a gas, comprising:

a silicon substrate having a pair of major surfaces;

a plurality of porous silicon regions formed in the silicon substrate between the pair of major surfaces, with each porous silicon region further comprising:

an inlet end located proximate to one of the major surfaces;

an outlet end located proximate to the other major surface; and a plurality of substantially straight pores extending through each porous silicon region between the inlet end and the outlet end, wherein the pores in each porous silicon region have a cross-section dimension which is substantially equal to or smaller than a mean free path of molecules of the gas being pumped through that porous silicon region with each adjacent pair of the porous silicon regions being interconnected by a flow channel extending through the silicon substrate from the outlet end of one porous silicon region of the pair to the inlet end of the other porous silicon region of the pair; and an electrical resistance heater located proximate to the outlet end of each of porous silicon region to provide a thermal gradient across that porous silicon region to pump the gas through that porous silicon region.

17. The MEM pump of claim 16 wherein the pores in one of the porous silicon regions have a cross-section size which is different from the cross-section size of the pores in another of the porous silicon regions.

18. The MEM pump of claim 16 wherein each electrical resistance heater is disposed on a lid which is attached to the major surface of the silicon substrate wherein the outlet end of each porous silicon region is located.

19. The MEM pump of claim 16 wherein each electrical resistance heater is supported on a suspended membrane.

20. A microelectromechanical (MEM) pump for pumping a gas, comprising a plurality of pump stages connected together in series, with each pump stage further comprising:

an inlet chamber and an outlet chamber separated by a porous silicon region, with the porous silicon region comprising a plurality of pores formed in a silicon substrate with each pore being substantially straight and having a cross-section size which is substantially equal to or smaller than a mean free path of the gas therein, wherein each adjacent pair of the pump stages are connected together in series by a channel extending from the outlet chamber of a first pump stage of the pair through the silicon substrate to the inlet chamber of a second pump stage of the pair; and an electrical resistance heater located within the outlet chamber of each pump stage to provide a thermal gradient directed along a length of the pores of that pump stage to draw the gas through the pores of that pump stage.

* * * * *